US005078388A

United States Patent [19]

Dempsey, Jr.

[11] Patent Number: 5,078,388

[45] Date of Patent: Jan. 7, 1992

[54] GRIP EXERCISING DEVICE

[76] Inventor: Levi T. T. Dempsey, Jr., 6701 Seat Pleasant Dr., Capital Heights, Md. 20743

[21] Appl. No.: 665,074

[22] Filed: Mar. 6, 1991

[51] Int. Cl.[5] ..... A63B 11/08

[52] U.S. Cl. ..... 272/67; 272/68; 272/135; 128/26

[58] Field of Search ..... 128/26; 272/67, 109, 272/68, 116, 143, 142, 68, 135, 136

[56] References Cited

U.S. PATENT DOCUMENTS

| | | | |
|---|---|---|---|
| Re. 28,845 | 6/1976 | Ratchford | 272/68 |
| 248,980 | 11/1881 | Atkins | 272/67 |
| 2,205,161 | 6/1940 | Vick | 272/68 |
| 3,570,849 | 3/1971 | Ratchford | 272/68 |
| 4,220,327 | 9/1980 | Herbowy | 128/26 |
| 4,226,412 | 10/1980 | Panepinto | 272/68 |
| 4,765,608 | 8/1988 | Bonasera | 272/67 |
| 4,783,067 | 11/1988 | Palmer | 272/68 |
| 4,988,091 | 1/1991 | Schaefer | 272/67 |

*Primary Examiner*—Steven R. Crow
*Assistant Examiner*—Jerome Donnelly
*Attorney, Agent, or Firm*—Peter L. Klempay

[57] ABSTRACT

The hand grip exercise device has a frame with spaced, parallel side rails, an end cross rail connecting the first ends of the side rails and a second cross rail parallel to the end cross rail and connecting the side rails at points spaced from the ends thereof, and a number of elastic cord lengths connected to and extending between the side rails in spaced, parallel relation to one another and between the two cross rails. Provision is made for connecting wrist-encircling straps to the extended portions of the side rails so that the device may be easily used by an individual having only limited coordination.

9 Claims, 1 Drawing Sheet

GRIP EXERCISING DEVICE

The present invention pertains to exercise devices and, more particularly, to exercise devices for the hand.

BACKGROUND OF THE INVENTION

U.S. Pat. No. 4,220,327, Herbowy, 1980, discloses a hand and wrist exercising device having a series of spaced, parallel elastic cords that the user engages with the fingers, the device having a base for supporting the user's wrist and forearm. Other examples of exercise devices for the hand and fingers to improve an individual's grip include those disclosed in U.S. Pat. Nos. 632,114, Hendrickson, 1889; 689,652, Perry, 1901; 2,205,161, Vick, 1940; 3,570,849, Ratchford, 1971; 4,226,412, Panepinto, 1980; and 4,783,067, Palmer, 1988.

One area in which grip exercisers are used is that of physical therapy. When the individual has only limited coordination, however, it may be difficult to use a grip exerciser properly as the device tends to fall from the hand when the grip is fully relaxed. Exercisers such as that of Herbowy avoid this problem as they are intended to be supported on a table or the like when in use. In some situations, this may not be practical or convenient for the user.

It is the primary object of the present invention to provide a hand grip exercise device which may be used by individuals having only limited coordination.

It is also an object of the present invention to provide such an exercise device which is of simple design and construction.

SUMMARY OF THE INVENTION

The above and other objects of the invention which will become apparent hereinafter are achieved by the provision of an exercise device for the hand which includes a lightweight tubular frame having a pair of spaced, parallel side rails, a first cross rail connecting the first ends of the side rails and a second cross rail extending parallel to the first cross rail and connecting the side rails between the ends thereof; a plurality of lengths of elastic cord connected to and extending between the side rails in the area between the two cross rails, the cords being in spaced, parallel relation to one another and parallel to the cross rails; and one or more releasable wrist encircling straps attached to the side rails between the second cross rail and the second ends of the side rails.

The device is used by engaging the second cross rail with the thumb and the elastic cords with the fingers. The wrist encircling straps serve to hold the device in place when the grip is fully relaxed.

For a more complete understanding of the invention and the objects and advantages thereof, reference should be had to the accompanying drawings and the following detailed description wherein a preferred embodiment of the invention is illustrated and described.

DESCRIPTION OF THE PREFERRED EMBODIMENT

Figure 1:
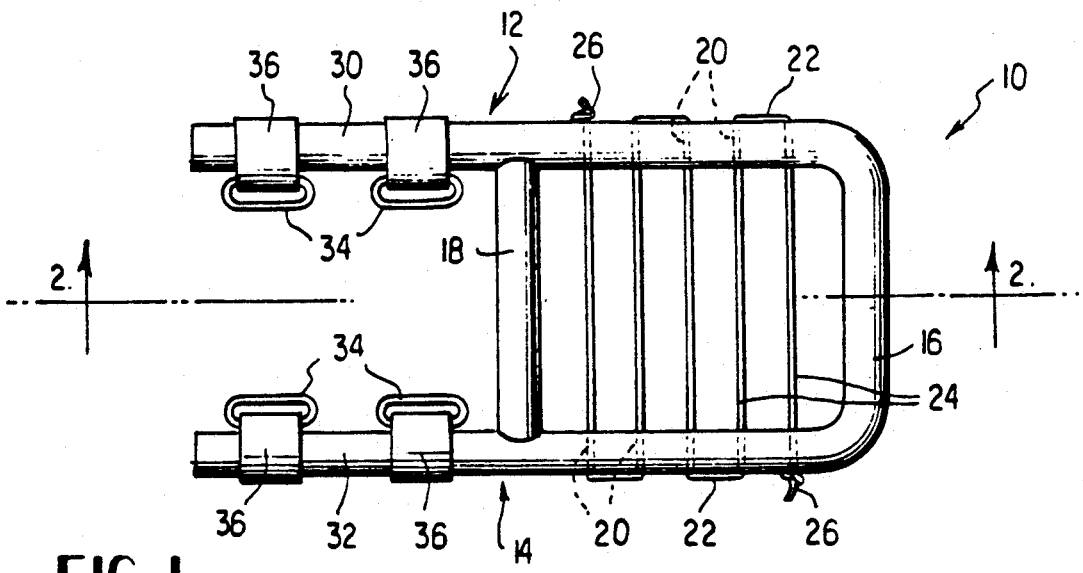
FIG. 1 is a plan view of the grip exercise device of the present invention.
Figure 2:
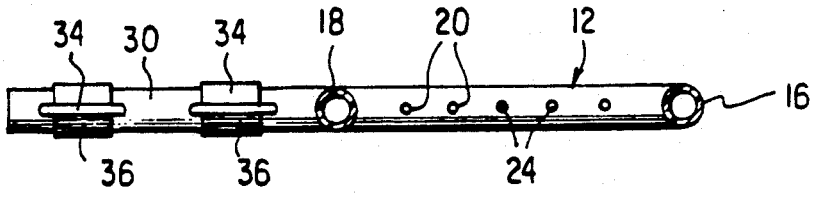
FIG. 2 is a cross sectional view taken on the line 2—2 of FIG. 1.

The grip exercise device of the present invention, designated generally by the reference numeral 10, includes a frame having a pair of spaced, parallel side rails 12 and 14 joined at one end by a first cross rail 16 and, at a point intermediate the ends thereof, by a second cross rail 18 extending parallel to the first cross rail. Each of the rails is, preferrably, formed of light weight, rigid plastic tubing. The portions of the side rails between the two cross rails are each provided with a series of through holes 20 the axes of which are parallel to the cross rails and which are, preferrably, uniformly spaced. An elastic cord 22 is threaded in sequence through the holes 22 to provide one or a plurality of cord lengths 24 extending in spaced, parallel relation between the two side rails, the ends of the cord 22 being tied in knots 26 to maintain tension on the cord. Alternatively, each of the cord lengths 24 may be a separate cord knotted at both ends.

Figure 3:
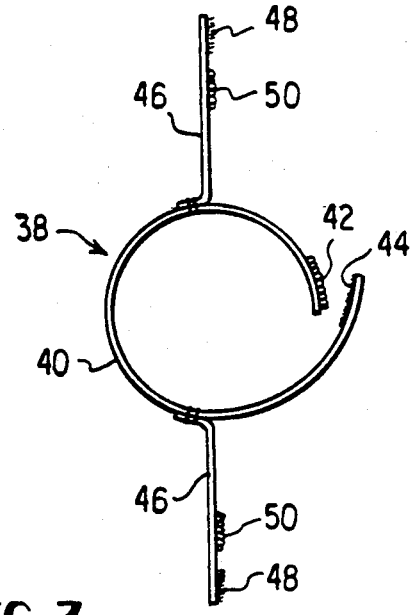
FIG. 3 is a side elevational view of a wrist-encircling strap used with the exercise device.

The portions 30, 32 of the side rails 12, 14 which extend beyond the second cross rail 18 away from the cord lengths 24 are each provided with two closed strap receiving loops 34, the loops being attached to the side rail portions by bands 36. The loops provide attachment points for wrist-encircling straps one of which is illustrated in FIG. 3 and designated generally by the reference numeral 38. The strap 38 includes a central fabric strap 40 of sufficient length as to encircle a human wrist with the ends of the strap overlapping, fasteners such as mating pieces 42 and 44 of hook and loop material, of the type identified by the trademark VELCRO, being attached at the ends of the strap to allow the same to be closed about the user's wrist. Connecting straps 46 are attached at one end to the wrist encircling strap by any suitable means, such as by being sewn thereto, the attachment points being located at generally diametrically opposed points when the wrist-encircling strap is closed about a wrist. The free end portions of the connecting straps are provided with cooperating fasteners which may, again, be patches 48 and 50 of mating hook and loop type material, the outer end portion carrying the patch 48 being folded back into engagement with the adjacent portion carrying the patch 50 after being threaded through the strap receiving loop 34.

Figure 4:
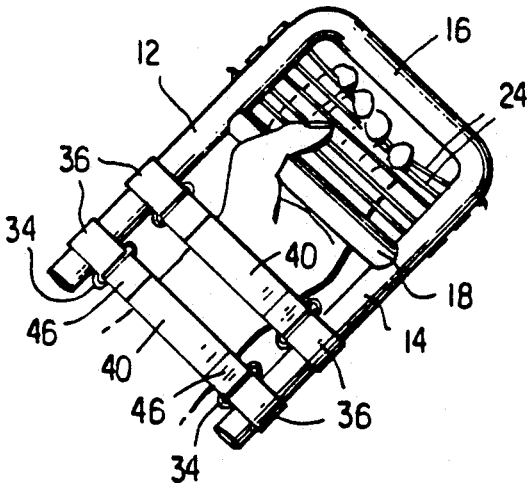
FIG. 4 is a perspective view showing the manner of using the grip exercise device.

The manner of using the exercise device is shown in FIG. 4. The user engages the second cross rail 18 with the thumb and one or more of the elastic cord lengths 24 with the fingers and closes the hand, working against the tension of the cords. In the event the user fully releases the grip on the device, the wrist-encircling straps 38 prevent the device from dropping from the hand which is of particular advantage when the user has only limited mobility or coordination.

While a preferred embodiment of the invention has been illustrated and described in detail herein, it will be understood that changes and additions may be had therein and thereto without departing from the spirit of the invention. Reference should, accordingly, be had to the appended claims in determining the true scope of the invention.

I claim:

1. A hand grip exercising device comprising:

a frame having a pair of spaced parallel side rails, a first cross rail connecting said side rails at one end thereof, and a second cross rail extending parallel to said first cross rail and connecting said side rails at points spaced from the ends thereof;

at least one elastic cord length extending in spaced, parallel relation to said first and second cross rails, said cord length being located between said first and second cross rails and connected to said side rails said side rails, said first and second cross rails and said cord length lying in a common plane; and means detachably connected to said side rails for attaching said exercise device to the user's wrist.

2. The hand grip exercising device of claim 1 wherein the portions of said side rails between said first and second cross rails are provided with a series of spaced through holes and a plurality of said cord lengths and wherein said elastic cord lengths are threaded through said holes.

3. The hand grip exercise device of claim 2 wherein said said elastic cord lengths comprise portions of a single elastic cord.

4. The hand grip exercise device of claim 1 wherein said means for attaching includes, for each of said side rails, at least one connecting link attached to said side rail at a point between said second cross rail and the second end of said side rail, and a wrist-encircling band having connecting straps attachable to said links.

5. A hand grip exercising device comprising:

a frame formed of lightweight, rigid tubing and having a pair of spaced parallel side rails, a first cross rail connecting said side rails at one end thereof, and a second cross rail extending parallel to said first cross rail and connecting said side rails at points spaced from the ends thereof;

at least one elastic cord length extending in spaced, parallel relation to said first and second cross rails, said cord length being located between said first and second cross rails and connected to said side rails; and means detachably connected to said side rails said side rails, said first and second cross rails and said cord length lying in a common plane for attaching said exercise device to the user's wrist.

6. The hand grip exercising device of claim 5 wherein the portions of said side rails between said first and second cross rails are provided with a series of spaced through holes and a plurality of said cord lengths and wherein said elastic cord lengths are threaded through said holes.

7. The hand grip exercise device of claim 6 wherein said said elastic cord lengths comprise portions of a single elastic cord.

8. The hand grip exercise device of claim 5 wherein said means for attaching includes, for each of said side rails, at least one connecting link attached to said side rail at a point between said second cross rail and the second end of said side rail, and a wrist-encircling band having connecting straps attachable to said links.

9. A hand grip exercise device comprising:

a frame having a pair of spaced, parallel side rails and first and second cross rails connecting said pair of side rails and extending in spaced, parallel relation to one another; and at least one elastic cord length extending in spaced, parallel relation to said cross rails, said cord length being located between said cross rails and connected to said side rails said side rails, said first and second cross rails and said cord length lying in a common plane;

the arrangement being such that a user's thumb engages one of said first and second cross rails and the fingers of the user's hand engage said cord length to perform exercise by opening and closing the hand against the tension of said cord length.

* * * * *